US005465426A

United States Patent [19]

Beaton

[11] Patent Number: 5,465,426

[45] Date of Patent: Nov. 14, 1995

[54] PHOTO CAP

[76] Inventor: Edward R. Beaton, P.O. Box 1175, Orangevale, Calif. 95662

[21] Appl. No.: 319,078

[22] Filed: Oct. 6, 1994

[51] Int. Cl.[6] ..... A42B 1/24

[52] U.S. Cl. ..... 2/195.1; 2/181; 2/209.13; 40/329

[58] Field of Search ..... 2/175.1, 195.1, 2/209.11, 209.12, 209.13, 209.14, 209.3, 209.4, 209.7, 171, 181, 181.2, 181.6, 422; 40/329

[56] References Cited

U.S. PATENT DOCUMENTS

| | | | |
|---|---|---|---|
| D. 68,685 | 11/1925 | Weinrott et al. . | |
| 929,240 | 7/1909 | Novoson . | |
| 1,787,568 | 1/1931 | Cooke . | |
| 2,803,829 | 8/1957 | Tscharner | 40/329 |
| 3,371,829 | 3/1968 | Phillips . | |
| 4,386,437 | 6/1983 | Fosher | 2/209.13 |
| 4,451,935 | 6/1984 | Henschel . | |
| 4,464,797 | 8/1985 | Glassman . | |
| 4,611,355 | 9/1986 | Galanto et al. . | |
| 4,625,337 | 12/1986 | Zahn . | |
| 4,650,219 | 3/1987 | Sigman . | |
| 4,776,043 | 10/1988 | Coleman . | |
| 4,873,726 | 10/1989 | Tapia . | |
| 5,003,640 | 4/1991 | Pizzacar . | |
| 5,070,545 | 12/1991 | Tapia . | |
| 5,136,726 | 4/1992 | Kellin et al. . | |
| 5,253,368 | 10/1993 | Blake . | |
| 5,276,985 | 1/1994 | Halloran . | |

*Primary Examiner*—Diana Biefeld
*Attorney, Agent, or Firm*—Knobbe, Martens, Olson & Bear

[57] ABSTRACT

A cap is disclosed which allows the wearer to display a photograph or other work of visual art through a transparent panel covering a cutout portion of the cap, providing protection for both the front and back surfaces of the photograph and having means for retaining the top and bottom of said photograph.

11 Claims, 2 Drawing Sheets

PHOTO CAP

BACKGROUND OF THE INVENTION

1. Field of the Invention

This invention pertains to wearing apparel, and more particularly to a cap having a cutout portion for viewing a photograph or other work of visual art.

2. Background of the Art

Various attempts have been made to display emblems, logos, and various other designs on baseball caps and other headgear. These existing caps rarely allow the user to personalize his or her own cap. It has been found desirable to provide means for displaying photographs or other works of visual art selected by the wearer on baseball-type caps or other similar headgear in such a manner that the photographs (or other works of visual art) are displayed from the inside of the cap, in such a manner that they can be easily changed but protected from the elements.

U.S. Pat. No. 2,803,829 discloses a picture cap having transparent pockets fixed on the outside of the cap, accessible through vertical slots on the outside of the cap. Changing the photo would require sliding the photo through the narrow vertical slot. In this design the vertical slot is exposed to the elements, and several layers of thickness are added to the cap by the photo pocket feature. U.S. Pat. No. D68,685 appears to disclose a similar design.

U.S. Pat. No. 929,240 discloses a cover for a cap, wherein the cover has a window through which existing numbers on the outside of the underlying cap may be visible. However, this cap-plus-cover system hides aesthetic features of the cap itself, is cumbersome to install and remove, and provides no means for retaining a photograph behind the window of the cover.

One object of the present invention is to provide a cap adapted for displaying a photo, wherein the photo display feature does not require such modification of the underlying cap as to detract from the aesthetics of that cap.

Another object of the present invention is to provide a photo display feature on a cap that does not add additional layers of material to the cap.

Still another object of the present invention is to provide a cap having a photo display feature wherein the photo is protected from the elements and is inserted and removed from inside the cap.

Yet another object of the present invention is to provide a cap having a photo display feature that can securely retain the photo but permits rapid exchange of the photo from inside the cap.

These and other advantages will be readily apparent from the detailed description of the invention that follows.

SUMMARY OF THE INVENTION

In accordance with the present invention, there is provided a cap to be worn on the head, comprising a generally hemispherical body having an interior surface, a peripheral edge, and a cutout opening therethrough; a transparent panel having a top and a bottom and covering said cutout; and an annular band attached to the peripheral edge and extending therefrom over a portion of the interior surface of the body of the cap. At least a portion of the band extends from the peripheral edge in the direction of the top of the transparent panel to define a slot at the bottom of the panel into which a photograph or other work of visual art may be inserted and held against the panel to be visible through the panel.

In a preferred embodiment, the cap further comprises a retainer at the top of the transparent panel extending from an attachment point inside the cap down toward the bottom of the panel so that a work of visual art inserted between the cap and the retainer is held against the panel by the retainer at the top of the panel and by the band at the bottom of the panel. The retainer preferably comprises a clip or a pocket.

In another preferred embodiment of the present invention, the cap further comprises an indicia-bearing sheet having a top and a bottom, wherein the bottom of the sheet is inserted into the slot at the bottom of the panel, and the top of the sheet is inserted between the cap and the retainer at the top of the panel, such that both the top and the bottom of the sheet are held against the panel such that the indicia on the sheet are visible through the panel. Preferably, the indicia is a photograph.

The cap of the present invention is preferably a baseball cap, and the transparent panel is preferably comprised of clear vinyl. In a preferred embodiment, the cutout is disposed in a front surface of the cap. The band attached to the peripheral edge of the cap preferably comprises a sweatband having a moisture barrier to prevent damage to a photograph held against the panel.

DETAILED DESCRIPTION OF THE INVENTION

In accordance with the present invention there is provided a photo cap which allows the user to display a sheet bearing indicia, such as a photograph or other work of visual art. The photo cap is preferably a baseball-type cap having a cutout, preferably located in the front of the cap. The cutout is covered by a transparent panel. A photograph, or other work of visual art, is inserted from inside the cap such that it can be viewed through the transparent panel. The photograph or other work of visual art is held in place against the transparent panel at its bottom edge by an annular band on the inside edge of the cap and, optionally, by a tab, clip, or other retainer positioned on the interior surface of the cap at the top of the panel.

The cap provides means for continually displaying a photograph or other work of visual art and for protecting both the front and back surfaces of the photograph from dirt and moisture. The cap also allows the wearer to remove and replace the photograph as desired from the interior of the cap.

Figure 1:
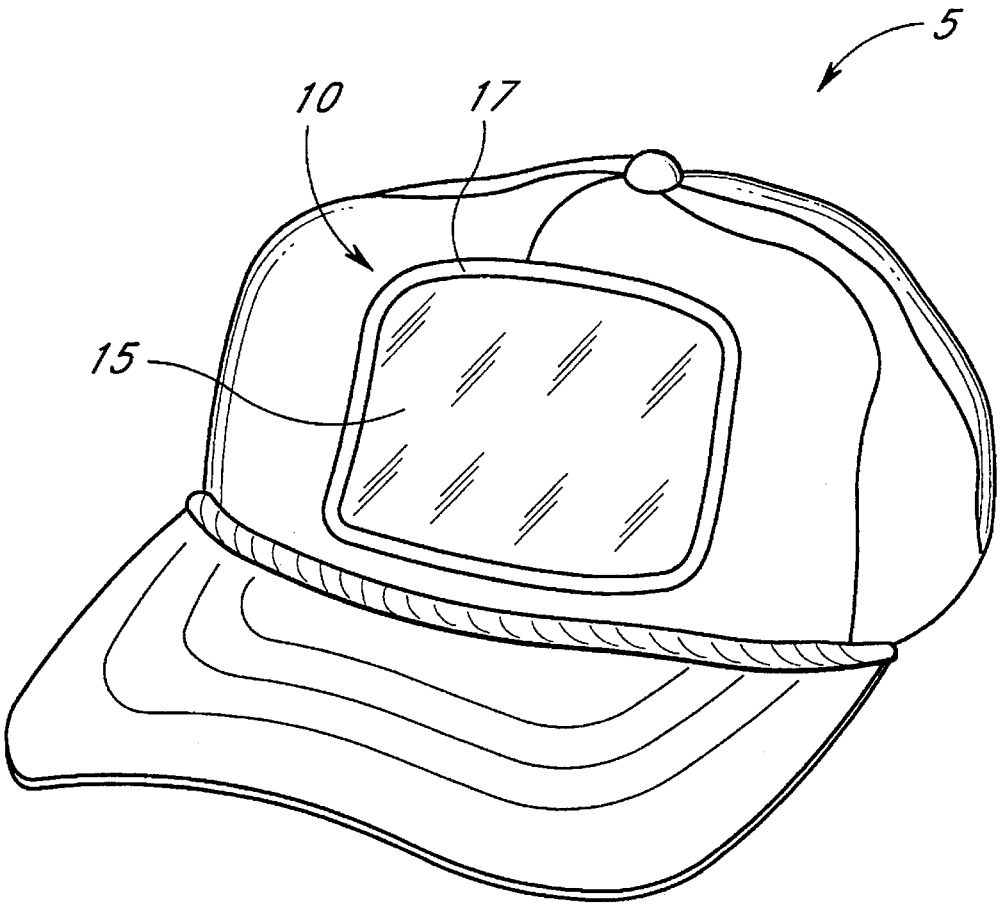
FIG. 1 is a front view of the photo cap of the present invention.

Accordingly, the present invention comprises a cap, such as a baseball cap, having a portion of the crown of the cap cutout to form a hole in the cap. As illustrated in FIG. 1, the cutout 10 is preferably located in the front of the cap 5. The cap is preferably made of natural or synthetic cloth, or other suitable, durable material. The cutout 10 is covered by a transparent panel 15 which is preferably comprised of clear vinyl, clear plastic, or other similar material. More preferably, the transparent panel 15 is comprised of vinyl that is clear, flexible, and from about 30 to 50 mil in thickness. The transparent panel 15 is positioned over the cutout 10 and securely fastened to the cap 5 by stitching, gluing, or other fastening means, on either the inside or the outside of the cutout. The visible edge of the cutout 10 or the panel 15 is preferably covered with bias tape or other suitable covering 17, outlining the cutout as shown in FIG. 1.

Figure 2:
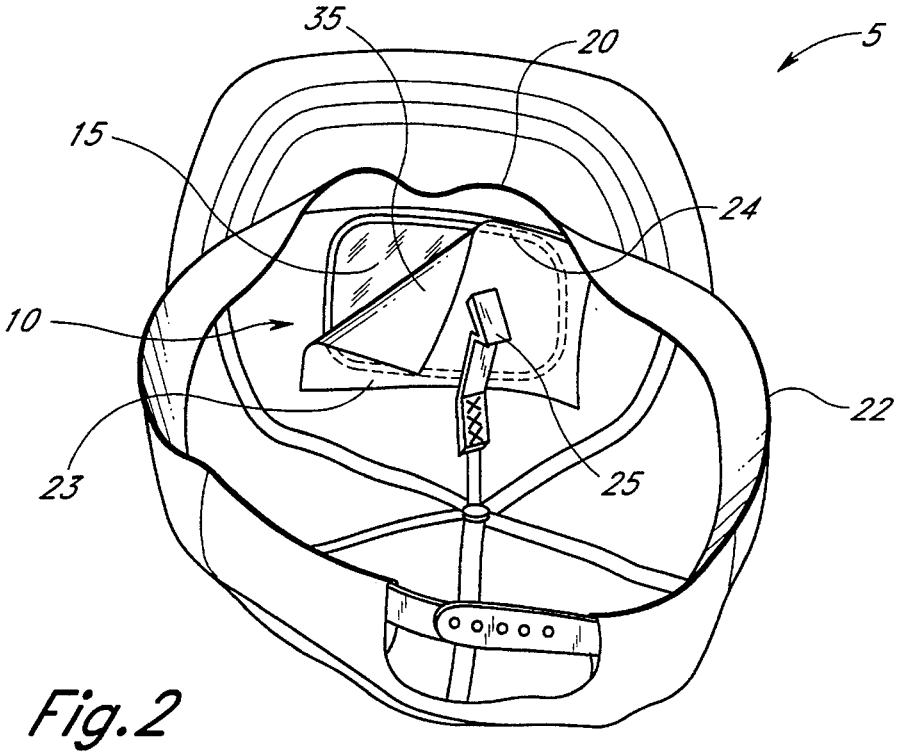
FIG. 2 is a top view of the interior of one embodiment of the photo cap of the present invention.

As illustrated in FIG. 2, a photograph 35 or other indicia-bearing sheet such as printed material or a work of visual art is held in place behind the transparent panel 15 by means of a vertically disposed annular band 20 fastened along the interior of the cap 5. Preferably, the band 20 comprises a sweatband having a moisture barrier comprised of thin plastic or other similar impermeable material which acts to prevent damage to the photograph 35 from dirt and moisture. The annular band 20 is sewn or otherwise fastened to the lower peripheral edge 22 of the cap 5, and extends upwardly and inwardly around the edge 22 of the cap 5 in the direction of the top 23 of the panel 15. The annular band preferably extends up to or even covers the bottom 24 of the transparent panel 15, defining a slot between the band 20 and the inside of the cap 5.

The top of the photograph 35 or other work of visual art may be further secured in place behind the transparent panel 15 by a retainer at the top of the panel. In one preferred embodiment of the present invention, illustrated in FIG. 2, the retainer comprises a clip 25. This clip 25 is preferably comprised of a piece of flexible plastic sewn into the top inside ridge of the cap 5. This clip 25 is used to aid in keeping the photograph 35 in position behind the transparent panel 15, as well as keeping the top of the photograph 25 abutting the interior surface of the transparent panel 15 for better viewing.

Figure 3:
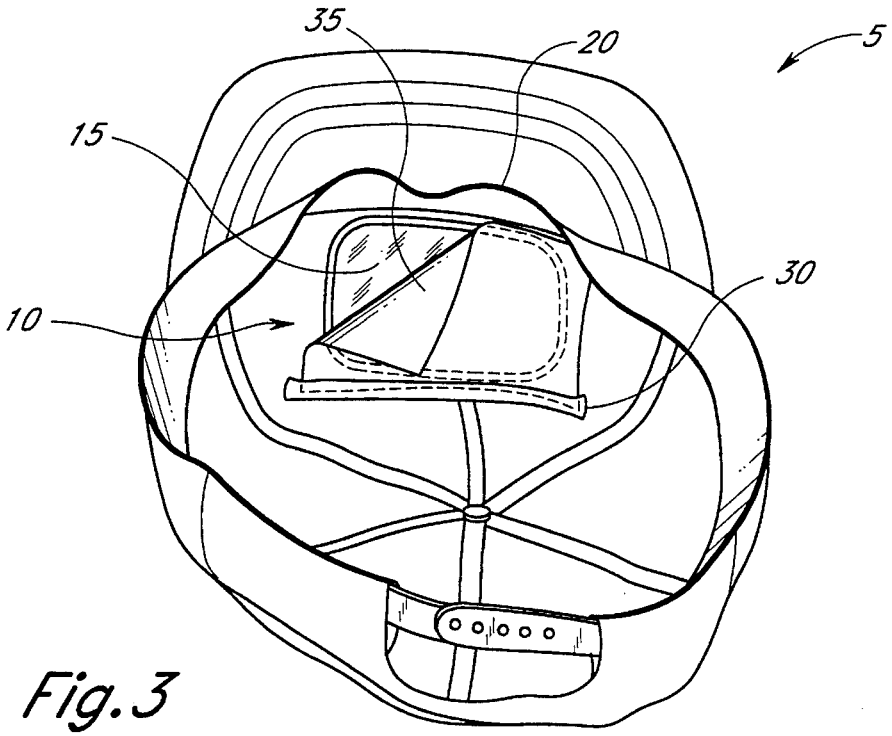
FIG. 3 is a top view of the interior of an alternative embodiment of the photo cap of the present invention.

Alternatively, as illustrated in FIG. 3, the retaining means comprises a pocket 30 which is sewn or otherwise attached to the interior surface of the cap 5. This shallow pocket 30 into which the photograph 35 or other work of visual art can be inserted functions to retain the photograph in its proper position for viewing. Note that the pocket 30 can also be provided at the bottom of the panel 15 in place of the band 20.

In a preferred embodiment, the transparent panel 15 is sized so as to display a standard size photograph 35. However, the size of the transparent panel 15 is limited only by the size of the cap 5, and various sizes are contemplated. For example, adequate dimensions may advantageously be from about 2 to 15 centimeters high and from about 2 to 20 centimeters wide, although other dimensions are also within the scope of this disclosure.

To display a photograph or other work of visual art in the cutout 10 of the cap 5 of the present invention, the user selects a desired photograph 35 for display. The user folds down the annular band 20 on the interior surface of the cap 5, inserts the lower edge of the photograph 35 behind the band 20, and then folds the band 20 back toward the interior surface of the cap 5, thus securing the lower edge of the photograph 35 behind the band 20. The upper edge of the photograph 35 is inserted behind the optional retainer (if provided), which secures the photograph 35 in its proper position behind the transparent panel 15. The cap 5 may then be placed on the head of the wearer, where the photograph 35 can be viewed by others.

Persons of ordinary skill in the art will appreciate that modifications may be made to this invention. Therefore, while this invention is described with reference to particular embodiments, it is to be understood that the invention is limited only by the claims which follow.

I claim:

1. A cap to be worn on the head, comprising:

a generally hemispherical body having an interior surface, a peripheral edge, and a cutout opening therethrough;

a transparent panel having a top and a bottom and permanently attached to and covering said cut-out; and an annular band having a top and a bottom, wherein the bottom of said band is attached to said peripheral edge and the top of the band is unattached, the band extending therefrom over a portion of the interior surface of said body, such that at least a portion of said band extends from said peripheral edge in the direction of the top of said transparent panel to define a horizontal slot inside the cap adjacent said panel into which a photograph or other work of visual art may be inserted and held against said panel to be visible through said panel.

2. The cap of claim 1, further comprising:

a retainer at the top of said transparent panel extending from an attachment point inside said cap down toward the bottom of said panel, said retainer having a closed top and an open bottom so that a work of visual art inserted from the interior of said cap into said open bottom between said cap and said retainer is held by said retainer at the top of said panel and by the band at the bottom of said panel.

3. The cap of claim 2, wherein said retainer comprises a pocket.

4. The cap of claim 2, further comprising an indicia-bearing sheet having a top and a bottom, wherein the bottom of said sheet is inserted into the slot at the bottom of said panel, and the top of said sheet is inserted between said cap and said retainer at the top of said panel, such that both the top and the bottom of said sheet are held against said panel such that said indicia on said sheet are visible through said panel.

5. The cap of claim 4, wherein said indicia comprise a photograph.

6. The cap of claim 1, wherein said cap is a baseball cap.

7. The cap of claim 1, wherein said transparent panel is comprised of clear vinyl.

8. The cap of claim 1, wherein said cutout is disposed in a front surface of said cap.

9. The cap of claim 1, wherein said band comprises a sweatband having a moisture barrier to prevent damage to a photograph held against said panel.

10. A cap to be worn on the head, comprising:

a generally hemispherical body having an interior surface, a peripheral edge, and a cutout opening therethrough;

a transparent panel having a top and a bottom and covering said cut-out;

an annular band attached to said peripheral edge and extending therefrom over a portion of the interior surface of said body, such that at least a portion of said band extends from said peripheral edge in the direction of the top of said transparent panel to define a slot at the bottom of said panel into which a photograph or other work of visual art may be inserted and held against said panel to be visible through said panel; and a clip at the top of said transparent panel extending from an attachment point inside said cap down toward the bottom of said panel so that a work of visual art inserted between said cap and said clip is held against said panel by said clip at the top of said panel and by the band at the bottom of said panel.

11. A cap to be worn on the head, comprising:

a generally hemispherical body having an interior surface having a top and a bottom, a peripheral edge along the bottom of said interior surface, and a cutout opening therethrough;

a transparent panel covering said cutout and fixedly attached to the interior surface of said body; and a pocket on the interior of the body against the transparent panel, said pocket having an opening through which a photograph or work of visual art may be inserted into said pocket and held against said transparent panel to be visible through said transparent panel, wherein said opening is a slot in the interior of the cap.

* * * * *